US005788553A

United States Patent [19]

Shivers et al.

[11] Patent Number: 5,788,553

[45] Date of Patent: Aug. 4, 1998

[54] MODEL AUTO RACETRACK WITH INTERCHANGEABLE COMPONENTS

[76] Inventors: Dennis Shivers, 12 Hilltop La., Ridge, N.Y. 11961; Richard C. Shivers, 211 Ivory Dr., Melbourne Beach, Fla. 32951

[21] Appl. No.: 822,357

[22] Filed: Mar. 20, 1997

[51] Int. Cl.[6] ..... A63H 33/04; A63H 18/00

[52] U.S. Cl. ..... 446/91; 446/444

[58] Field of Search ..... 446/91, 118, 110, 446/484, 485, 444, 446, 447, 85, 90, 3

[56] References Cited

U.S. PATENT DOCUMENTS

| | | | |
|---|---|---|---|
| 3,352,054 | 11/1967 | Glass et al. | 446/91 |
| 3,696,548 | 10/1972 | Teller | 446/91 |
| 4,291,877 | 9/1981 | Ensmann et al. | 446/409 X |

FOREIGN PATENT DOCUMENTS

| | | | |
|---|---|---|---|
| 999876 | 2/1952 | France | 446/118 |
| 1225394 | 3/1971 | United Kingdom | 446/118 |

*Primary Examiner*—Robert A. Hafer
*Assistant Examiner*—D. Neal Muir
*Attorney, Agent, or Firm*—Brian S. Steinberger; Law Offices of Brian S. Steinberger

[57] ABSTRACT

A model auto racetrack with interchangeable components that are modular and used to replicate a real racetrack environment and which are interchangeable with each other and selectively positionable so as to allow the model auto racetrack to replicate any racetrack desired by a user. The model auto racetrack includes a baseboard, at least one component module, component module mounting apparatus, a track module, and track module mounting apparatus. The at least one component module is interchangeably mounted at any position on the baseboard so as to replicate a real racetrack environment and is interchangeable with each other so as to allow the model auto racetrack to replicate any racetrack desired by the user. The at least one component module is at least one of at least one grandstand module, at least one cement wall module, at least one garage module, at least one concession stand module, at least one press box module, at least one landscape module, and at least one fence module. The component module mounting apparatus interchangeably mounts the at least one component module to any position on the baseboard. The track module is interchangeably mounted on the baseboard. And, the track module mounting apparatus interchangeably mounts the track module on the baseboard.

12 Claims, 2 Drawing Sheets

Fig. 1
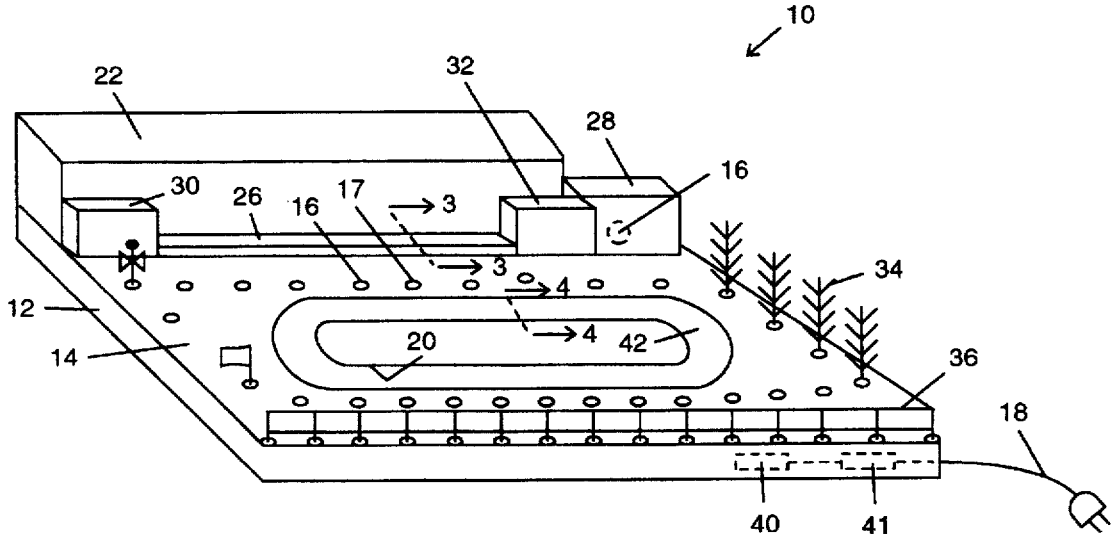
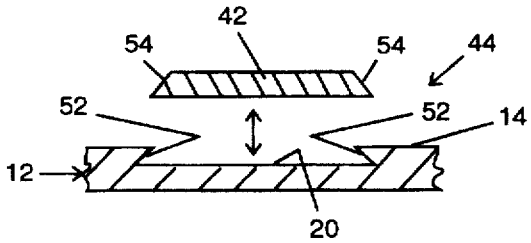
Fig. 4
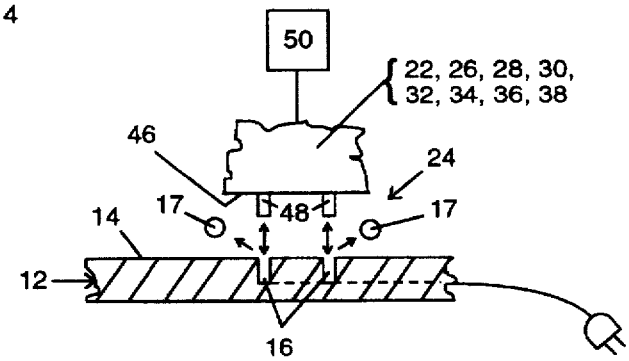
Fig. 3

MODEL AUTO RACETRACK WITH INTERCHANGEABLE COMPONENTS

BACKGROUND OF THE INVENTION

1. Field of the Invention:

The present invention relates to a model auto racetrack. More particularly, the present invention relates to a model auto racetrack with interchangeable components.

2. Description of the Prior Art:

Numerous innovations for layouts have been provided in the prior art that will be described. Even though these innovations may be suitable for the specific individual purposes to which they address, however, they differ from the present invention.

FOR EXAMPLE, U.S. Pat. No. Des. 246, 1996 to Suzuki teaches the ornamental design for a toy racing trackway.

ANOTHER EXAMPLE, U.S. Pat. No. Des. 248,887 to Tanaka teaches the ornamental design for a toy trackway.

STILL ANOTHER EXAMPLE, U.S. Pat. No. Des. 249, 289 to Burcham teaches the ornamental design for a toy auto trackway.

YET ANOTHER EXAMPLE, U.S. Pa. No. Des. 257,272 to Eddins et al. teaches the ornamental design for a toy race track for miniature cars.

STILL YET ANOTHER EXAMPLE, U.S. Pat. No. Des. 302,032 to Kamikawa teaches the ornamental design for a toy racetrack.

FINALLY, YET STILL ANOTHER EXAMPLE, U.S. Pat. No. 5,348,478 to Bradshaw teaches a modular terrain board having a plurality of sections or terrain cell plugs which are held in place by a baseboard assembly having a corresponding plurality of cell receiving sections or cells formed therein. The terrain cell plugs are removable to allow reconfiguration of the terrain model.

It is apparent that numerous innovations for layouts have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a model auto racetrack with interchangeable components that avoids the disadvantages of the prior art.

ANOTHER OBJECT of the present invention is to provide a model auto racetrack with interchangeable components that is simple and inexpensive to manufacture.

STILL ANOTHER OBJECT of the present invention is to provide a model auto racetrack with interchangeable components that is simple to use.

BRIEFLY STATED, YET ANOTHER OBJECT of the present invention is to provide a model auto racetrack with interchangeable components that are modular and used to replicate a real racetrack environment and which are interchangeable with each other and selectively positionable so as to allow the model auto racetrack to replicate any racetrack desired by a user. The model auto racetrack includes a baseboard, at least one component module, component module mounting apparatus, a track module, and track module mounting apparatus. The at least one component module is interchangeably mounted at any position on the baseboard so as to replicate a real racetrack environment and is interchangeable with each other so as to allow the model auto racetrack to replicate any racetrack desired by the user. The at least one component module is at least one of at least one grandstand module, at least one cement wall module, at least one garage module, at least one concession stand module, at least one press box module, at least one landscape module, and at least one fence module. The component module mounting apparatus interchangeably mounts the at least one component module to any position on the baseboard. The track module is interchangeably mounted on the baseboard. And, the track module mounting apparatus interchangeably mounts the track module on the baseboard.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention;

FIG. 3 is an enlarged cross sectional view, with parts broken away, taken on LINE 3—3 in FIG. 1 and illustrating the component mounting apparatus of FIG. 2; and FIG. 4 is an enlarged cross sectional view, with parts broken away, taken on LINE 4—4 in FIG. 1 and illustrating the track mounting apparatus of FIG. 2.

LIST OF REFERENCE NUMERALS

UTILIZED IN THE DRAWING

Figure 2:
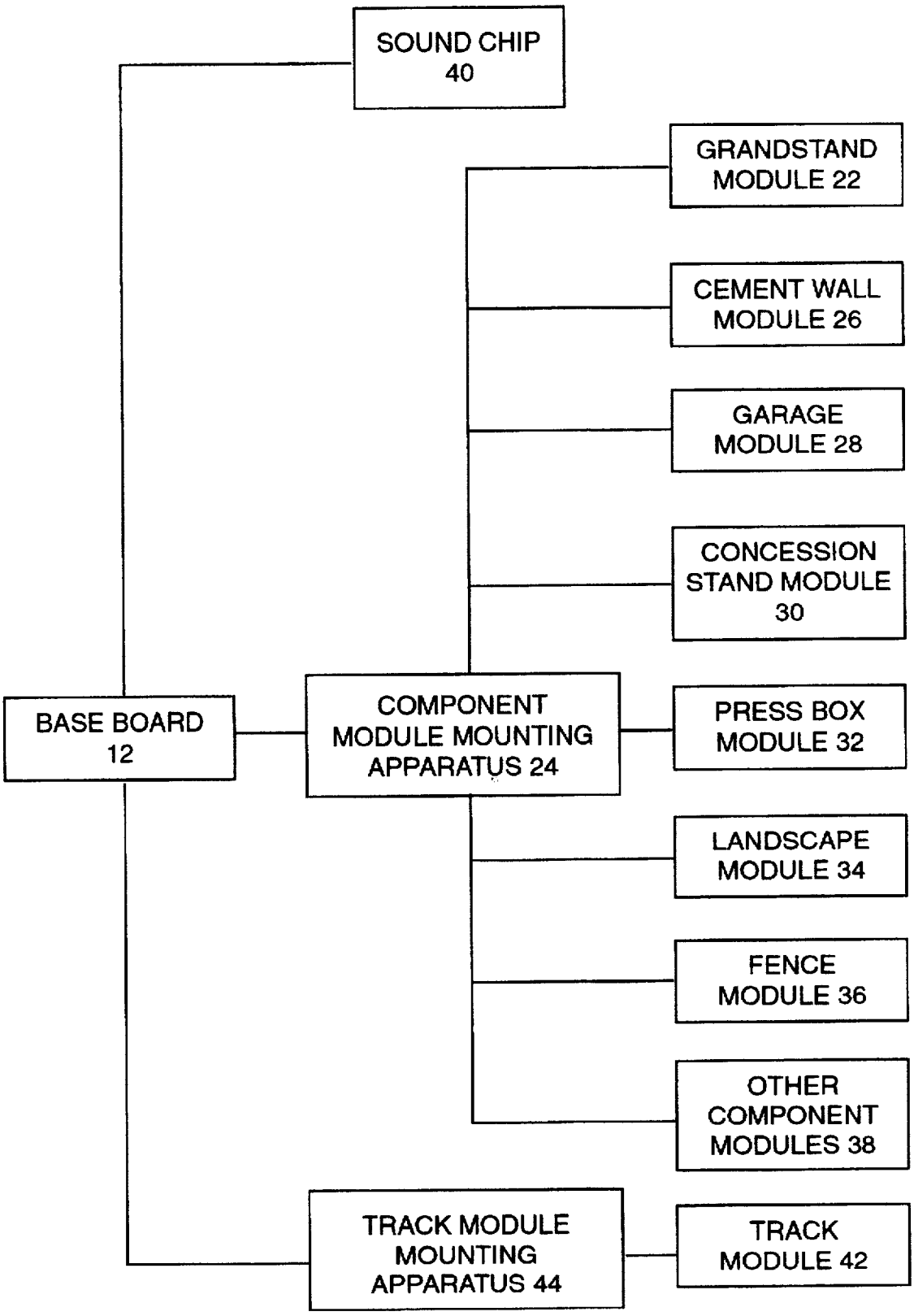
FIG. 2 is a system diagram representing the interconnection of components of the present invention shown in FIG. 1.

10 model auto racetrack with interchangeable components of the present invention
12 baseboard
14 upper surface of baseboard 12
16 plurality of apertures in upper surface 14 of baseboard 12
17 lids of plurality of apertures 16 in upper surface 14 of baseboard 12
18 power cord
20 recess in upper surface 14 of baseboard 12
22 at least grandstand module
24 component maintaining apparatus
26 at least one cement wall module
28 at least one garage module
30 at least one concession stand module
32 at least one press box module
34 at least one landscape module
36 at least one fence module
38 any other component modules
40 sound chip
41 activating switch for sound chip 40
42 track module
44 track module maintaining apparatus for track module 42

46 surface of component mounting apparatus 24

48 at least one prong of component mounting apparatus 24

50 electrical devices 52 longitudinal sides of recess 20 in upper surface 14 of baseboard 12 of track module mounting apparatus 44

54 longitudinal sides of track module 42 of track module mounting apparatus 44

DETAILED DESCRIPTION OF THE PREFERRED EMBODIMENT

Referring now to the figures in which like numerals indicate like parts, and particularly to FIG. 1 and FIG. 2, the model auto racetrack with interchangeable components of the present invention is shown generally at 10 and includes components that are modular and replicate a real track environment and which are interchangeable with each other both in component and positioning so as to allow the model auto racetrack with interchangeable components 10 to replicate any racetrack desired by the user.

The model auto racetrack with interchangeable components 10 includes a baseboard 12 that has an upper surface 14 with a plurality of apertures 16 disposed vertically therein which are electrically conductive and positioned in a plurality of rows and columns thereon.

The plurality of apertures 16 in the upper surface 14 of the baseboard 12 are in electrical communication with a power cord 18 that is selectively plugged into a power source (not shown) so as to allow the plurality of apertures 16 in the upper surface 14 of the baseboard 12 to be in electrical communication with the power source (not shown). The plurality of apertures 16 in the upper surface 14 of the baseboard 12 are selectively closed by lids 17 so as to cover those apertures of the plurality of apertures 16 in the upper surface 14 of the baseboard 12 not being used, especially since they are electrically conductive.

The baseboard 12 further has a recess 20 therein that is oval-shaped and positioned closer to one longitudinal side of the baseboard 12 than another longitudinal side of the baseboard 12.

The model auto racetrack with interchangeable components 10 further includes at least grandstand module 22 that is interchangeably disposed at any position on the upper surface 14 of the baseboard 12, and is maintained thereat by component module maintaining apparatus 24.

The model auto racetrack with interchangeable components 10 further includes at least one cement wall module 26 that is interchangeably disposed at any position on the upper surface 14 of the baseboard 12, and is maintained thereat by the component module maintaining apparatus 24.

The model auto racetrack with interchangeable components 10 further includes at least one garage module 28 that is interchangeably disposed at any position on the upper surface 14 of the baseboard 12, and is maintained thereat by the component module maintaining apparatus 24.

The model auto racetrack with interchangeable components 10 further includes at least one concession stand module 30 that is interchangeably disposed at any position on the upper surface 14 of the baseboard 12, and is maintained thereat by the component module maintaining apparatus 24.

The model auto racetrack with interchangeable components 10 further includes at least one press box module 32 that is interchangeably disposed at any position on the upper surface 14 of the baseboard 12, and is maintained thereat by the component module maintaining apparatus 24.

The model auto racetrack with interchangeable components 10 further includes at least one landscape module 34 that is interchangeably disposed at any position on the upper surface 14 of the baseboard 12, and is maintained thereat by the component module maintaining apparatus 24.

The model auto racetrack with interchangeable components 10 further includes at least one fence module 36 that is interchangeably disposed at any position on the upper surface 14 of the baseboard 12, and is maintained thereat by the component module maintaining apparatus 24.

It is to be understood, however, that the use of the at least one grandstand module 22, the at least one cement wall module 26, the at least one garage module 28, the at least one concession stand module 30, the at least one press box module 32, the at least one landscape module 34, and the at least one fence module 36 are by no means exhaustive of the various components that can be interchangeably attached to the baseboard 12; any other component modules 38 that are indicative of a race track can be added thereto, such as but not limited to, flags, advertising bill boards, and the like, without departing in any way from the spirit of the present invention.

The model auto racetrack with interchangeable components 10 further includes a sound chip 40 that articulates real racetrack sounds and which is disposed in the baseboard 12, and is in electrical communication with the power cord 18 and an activating switch 41.

The model auto racetrack with interchangeable components 10 further includes a track module 42 that is resilient and interchangeably disposed in, and fills, the recess 20 in the upper surface 14 of the baseboard 12, and is maintained therein by track module maintaining apparatus 44.

The configuration of the component module mounting apparatus 24 can best be seen in FIG. 3, and as such will be discussed with reference thereto.

The component module mounting apparatus 24 includes each of 16 the at least one grandstand module 22, the at least one cement wall module 26, the at least one garage module 28, the at least one concession stand module 30, the at least one press box module 32, the at least one landscape module 34, the at least one fence module 36, and the any other component modules 38 having a surface 46 that abuts against the upper surface 14 of the baseboard 12, with at least one prong 48 extending downwardly therefrom that is electrically conductive and which is frictionally received in a corresponding aperture 16 of the plurality of apertures 16 in the upper surface 14 of the baseboard 12, where it is in electrical communication therewith.

It is to be further understood that any of the baseboard 12, the at least one grandstand module 22, the at least one cement wall module 26, the at least one garage module 28, the at least one concession stand module 30, the at least one press box module 32, the at least one landscape module 34, the at least one fence module 36, and the any other component modules 38 can have electrical devices 50 therewith, such as but not limited to, lights, loud speakers, and the like. If so, the electrical devices 50 are in electrical communication with a respective prong 48 of the at least one prong 48 of the component mounting apparatus 24 which receives power from its electrical connection with the corresponding aperture 16 of the plurality of apertures 16 in the upper surface 14 of the baseboard 12.

The configuration of the track module mounting apparatus 44 can best be seen in FIG. 4, and as such will be discussed with reference thereto.

The track module mounting apparatus 44 includes the recess 20 in the upper surface 14 of the baseboard 12 being defined by longitudinal sides 52 thereof that are inclined and extend downwardly and outwardly from the upper surface 14 of the baseboard 12 that compressibly receive longitudinal sides 54 of the track module 42 that are inclined and extend downwardly and outwardly.

It will be understood that each of the elements described above, or two or more together, may also find a useful application in other types of constructions differing from the types described above.

While the invention has been illustrated and described as embodied in a model auto racetrack with interchangeable components, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A model auto racetrack that replicates a real racetrack, the model auto racetrack comprising in combination:

a rectangular baseboard having a first longitudinal side and a second longitudinal side;

a grandstand mounted adjacent to the first longitudinal side of the baseboard;

a substantially oval-shaped recess in the baseboard between the grandstand and the second longitudinal side of the baseboard, said recess has inclined sides; and a vehicle track surface mounted in the oval-shaped recess having sides conforming to said recess sides, wherein the locations of grandstand, the oval-shaped recess and the vehicle track surface replicate any real auto racetrack.

2. A three-dimensional model auto racetrack that replicates a real racetrack, the three-dimensional model auto racetrack comprising in combination:

a rectangular baseboard having a first longitudinal side and a second longitudinal side;

a grandstand mounted adjacent to the first longitudinal side of the baseboard;

a substantially oval-shaped recess in the baseboard between the grandstand and the second longitudinal side of the baseboard, said recess has inclined sides; and a vehicle track surface mounted in the oval-shaped recess having sides conforming to said recess sides, wherein the grandstand, the oval-shaped recess and the vehicle track surface together can be a replica model of any real auto racetrack.

3. A model auto racetrack with interchangeable components that are modular and used to replicate a real racetrack environment and which are interchangeable with each other and selectively positionable so as to allow said model auto racetrack to replicate any racetrack desired by a user, comprising:

a) a baseboard;

b) an oval-shaped recess in the baseboard that is positioned closer to one longitudinal side of said baseboard than another longitudinal side of said baseboard c) at least one component module interchangeably mounted at a selected position on said baseboard so as to replicate a real racetrack environment and being interchangeable so as to allow said model auto racetrack to replicate any racetrack desired by the user; said at least one component module being at least one of:

i) at least one grandstand module;

ii) at least one cement wall module;

iii) at least one garage module;

iv) at least one concession stand module;

v) at least one press box module;

vi) at least one landscape module; and vii) at least one fence module;

d) component module mounting means for interchangeably mounting said at least one component module to the selected position on said baseboard;

e) a track module interchangeably mounted on said oval-shaped recess; and f) track module mounting means for interchangeably mounting said track module on said baseboard.

4. The racetrack as defined in claim 3, wherein said baseboard has an upper surface with a plurality of apertures disposed vertically therein which are electrically conductive and which are positioned in a plurality of rows and columns thereon.

5. The racetrack as defined in claim 4, wherein said plurality of apertures in said upper surface of said baseboard are in electrical communication with a power cord that is selectively plugged into a power source so as to allow said plurality of apertures in said upper surface of said baseboard to be in electrical communication with said power source.

6. The racetrack as defined in claim 4, wherein said plurality of apertures in said upper surface of said baseboard are selectively closed by lids so as to cover those apertures of said plurality of apertures in said upper surface of said baseboard not being used.

7. The racetrack as defined in claim 4; wherein said at least one component module is interchangeably mounted at any position on said upper surface of said baseboard.

8. The racetrack as defined in claim 5, further comprising a sound chip articulating real racetrack sounds and being disposed in said baseboard and being in electrical communication with said power cord and having an activating switch.

9. The racetrack as defined in claim 3, wherein said track module is interchangeably disposed in, and fills, said recess in an upper surface of said baseboard, and is maintained therein by said track module mounting means.

10. The racetrack as defined in claim 4, wherein said component module mounting means includes each of said at least one component module having a surface that abuts against said upper surface of said baseboard with at least one prong extending downwardly therefrom that is electrically conductive and which is frictionally received in a corresponding aperture of said plurality of apertures in said upper surface of said baseboard, where it is in electrical communication therewith.

11. The racetrack as defined in claim 10, wherein at least one of said at least one component module has at least one electrical device therewith that is in electrical communication with a respective prong of said at least one prong of said component mounting means which receives power from its electrical connection with said corresponding aperture of said plurality of apertures in said upper surface of said baseboard.

12. The racetrack as defined in claim 3, wherein said track module mounting means includes said recess in an upper surface of said baseboard being defined by longitudinal sides thereof that are inclined and extend downwardly and outwardly from said upper surface of said baseboard that compressibly receives longitudinal sides of said track module that are inclined and extend downwardly and outwardly.

* * * * *